US006230465B1

(12) United States Patent
Messenger et al.

(10) Patent No.: US 6,230,465 B1
(45) **Date of Patent: *May 15, 2001**

(54) PRECAST CONCRETE STRUCTURAL MODULES

(75) Inventors: Harold G. Messenger, Rehoboth, MA (US); Gordon L. Brown, Jr., Anderson, SC (US)

(73) Assignee: Oldcastle Precast, Inc., Rehoboth, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/129,058

(22) Filed: Aug. 4, 1998

(51) Int. Cl.[7] ..... E04C 2/06; E04C 5/07

(52) U.S. Cl. ..... 52/630; 52/602; 52/309.14; 52/309.17; 52/660; 52/745.19

(58) Field of Search ..... 52/630, 602, 414, 52/309.14, 309.17, 742.14, 745.19, 454, 600, 660

(56) References Cited

U.S. PATENT DOCUMENTS

| | | | | |
|---|---|---|---|---|
| 890,011 | * | 6/1908 | Anderson | 52/602 X |
| 1,229,904 | * | 6/1917 | Day | 52/602 X |
| 1,420,246 | * | 6/1922 | Faber | 52/602 X |
| 1,484,206 | * | 2/1924 | Birkholz | 52/602 |
| 1,834,892 | * | 12/1931 | Betzler | 52/602 X |
| 1,891,837 | * | 12/1932 | Pittman | 52/602 X |
| 1,897,327 | * | 2/1933 | Olson | 52/620 |
| 2,080,618 | * | 5/1937 | Madsen | 52/602 X |
| 2,312,293 | * | 2/1943 | Weiss | 52/600 X |
| 3,567,816 | * | 3/1971 | Embree | 52/602 X |
| 3,597,890 | * | 8/1971 | Hala | 52/309.17 |
| 4,019,297 | * | 4/1977 | Murphy | 52/309.2 |
| 4,229,497 | * | 10/1980 | Piazza | 52/309.12 X |
| 4,233,787 | * | 11/1980 | Piazza | 52/602 X |
| 4,612,748 | * | 9/1986 | Arnold et al. | 52/600 X |
| 4,617,219 | * | 10/1986 | Shupack | 52/782.1 X |
| 4,841,702 | * | 6/1989 | Huettemann | 52/309.12 |
| 4,916,004 | * | 4/1990 | Ensminger et al. | 428/192 |
| 4,934,121 | * | 6/1990 | Zimmerman | 52/602 X |
| 5,032,340 | * | 7/1991 | Akihama et al. | 264/258 |
| 5,095,674 | * | 3/1992 | Huettemann | 52/309.11 X |
| 5,317,848 | * | 6/1994 | Abbey | 52/630 X |
| 5,493,836 | * | 2/1996 | Lopez-Munoz | 52/602 |
| 5,493,838 | * | 2/1996 | Ross | 52/745.1 |
| 5,758,463 | | 6/1998 | Mancini, Jr. . | |
| 5,836,715 | | 11/1998 | Hendrix et al. . | |

FOREIGN PATENT DOCUMENTS

| | | | | |
|---|---|---|---|---|
| 114294 | * | 12/1941 | (AU) | 52/602 |
| 16478 | * | 10/1980 | (EP) | 52/602 |
| 545526 | * | 6/1942 | (GB) | 52/602 |
| 2202175 | * | 8/1988 | (GB) | 52/630 |

* cited by examiner

*Primary Examiner*—Laura A. Callo
(74) *Attorney, Agent, or Firm*—Sheridan Ross P.C.

(57) ABSTRACT

A precast concrete modular device using thin coffered sections reinforced preferably with carbon and/or glass fiber scrim grids, in between steel reinforced ribs is provided. The thin reinforced sections stiffen the steel reinforced precast frame. The thin sections preferably have a thickness less than about two inches, preferably less than about 1½ inch, and more preferably less than about 1 inch. The resultant modules have an areal weight of less than about 40 lbs. per square foot.

18 Claims, 5 Drawing Sheets

PRECAST CONCRETE STRUCTURAL MODULES

Cross reference is made to U.S. patent application Ser. No. 08/866,422 filed May 31, 1997 which claims priority in provisional application Ser. No. 60/018,753 filed May 31, 1996, and to provisional application Ser. No. 60\054,842, filed Aug. 5, 1997 all incorporated by reference.

The present invention relates to precast concrete structural modules and in particular to modules having a framework of reinforced ribs with panels reinforced by non-metallic material.

BACKGROUND INFORMATION

One of the most important factors in the feasibility of precast structural modules is the weight of the modules and in particular, the weight per square foot. In this regard, structural modules refers, in general, to modules which form all or a part of a weight-bearing wall, floor/ceiling or similar structure.

It has been known to provide structural modules with a "waffle" configuration in which relatively thick "rib" components form a framework and panel portions extend between the ribs. In many configurations, particularly where structural or load-bearing modules are involved, metallic mesh or reinforcing bars (rebar) typically steel bars, were provided extending through at least a portion of the panel sections. Because of the potential for corrosion and/or rusting of the reinforcing bars and/or the potential for deterioration of the concrete adjacent the reinforcing bars, such configurations typically required a minimum of one inch or more "cover" i.e. such that steel reinforcing bars were spaced at least about one inch from any major surface of the module. In previous devices, this meant that the panel thickness was often a minimum of three inches and typically more, leading to relatively high weight per square foot. Accordingly, it would be useful to provide a precast concrete structural module which is relatively low in weight per square foot yet provides sufficient cover to any reinforcement in the panels.

To achieve the desired stiffness of the framework defined by the rib portions, the panel portions are typically required to bear an amount of tension. Because concrete, alone, is much more tolerant of compression than tension, it would be advantageous to provide a module having panels configured to withstand substantial tension without having so much panel thickness that the overall panel weight is undesirable.

The relatively large weight per square foot of previous modules has resulted in relatively high expense arising not only from the amount of materials needed for fabrication, but also the cost of transporting and erecting the modules. Module weight also placed effective limits on the height of structures, such as stacked modules, e.g. due to limitations on the total weight carried by the lowermost modules. Furthermore, there is substantial fabrication labor expense that can arise from efforts needed to position, design and construct molds, and the materials and labor costs involved in providing and placing reinforcement materials. Accordingly, it would be useful to provide a system for modular construction which is relatively light, can be readily stacked to heights greater than in previous configurations and, preferably, inexpensive to design and use.

In many situations, panels or modules are situated in locations where it is desirable to have openings therethrough to accommodate cables, pipes and the like. In some previous approaches, panels were required to be specially designed and cast so as to include any necessary openings, requiring careful planning and design and increasing costs due to the special, non-standard configuration of such panels. In other approaches, panels were cast without such openings and the openings were formed after casting e.g. by drilling or similar procedures. Such post-casting procedures as drilling, particularly through the relatively thick and/or steel-reinforced panels as described above, was a relatively labor-intensive and expensive process. In many processes for creating openings, there was a relatively high potential for cracking or splitting of a panel or module. Accordingly, it would be useful to provide a module which can be easily provided with openings in desired locations, preferably in the field, with reduced potential for cracking or splitting.

SUMMARY OF THE INVENTION

According to the present invention, a structural precast concrete module with reinforced rib portions connected by panel portions is provided in which a non-metallic material is used in the panel portions for reinforcement. In one embodiment, the nonmetallic panel reinforcement material includes carbon fiber, preferably formed in a mesh configuration. In another embodiment, the non-metallic panel reinforcement material includes glass fiber, also preferably in a mesh configuration and preferably coated such as with (preferably fire-resistant) resin and/or a rubber or rubber-like material. In one embodiment, the non-metallic reinforcement includes both glass fiber (e.g. for economy and early strength) and carbon fiber (e.g. every fourth or fifth grid in a one inch grid pattern), e.g. for long-term strength. Preferably, the panel portions formed in this fashion have a thickness of less than about one inch and preferably about ¾ inch or less. In one embodiment, the modules have a weight per square foot as low as 30–40 lbs. (or less).

DETAILED DESCRIPTION OF THE PREFERRED EMBODIMENT

Figure 1:
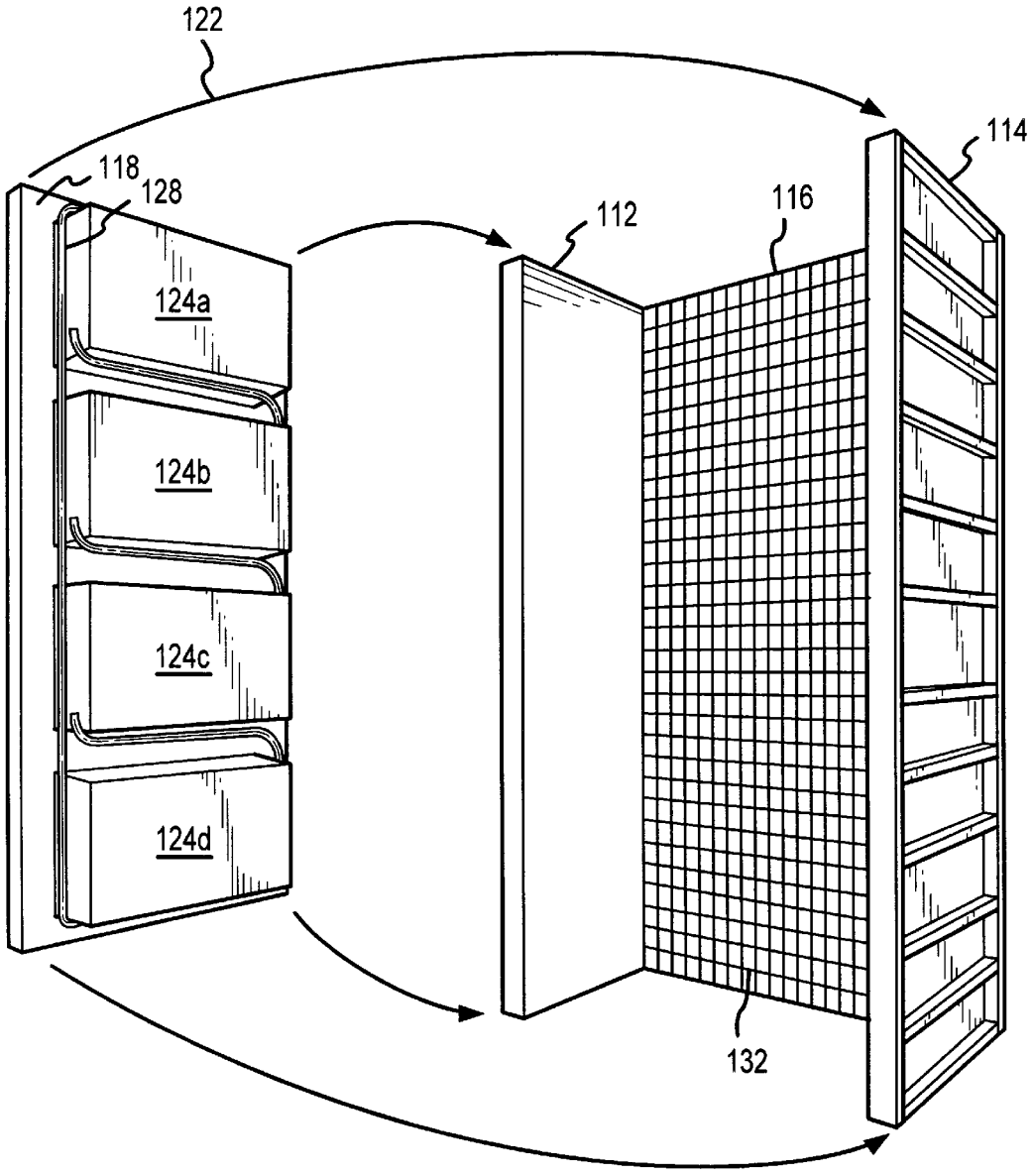
FIG. 1 is a partially exploded perspective view of a mold and positioned reinforcement material usable in connection with an embodiment of the present invention.
Figure 2:
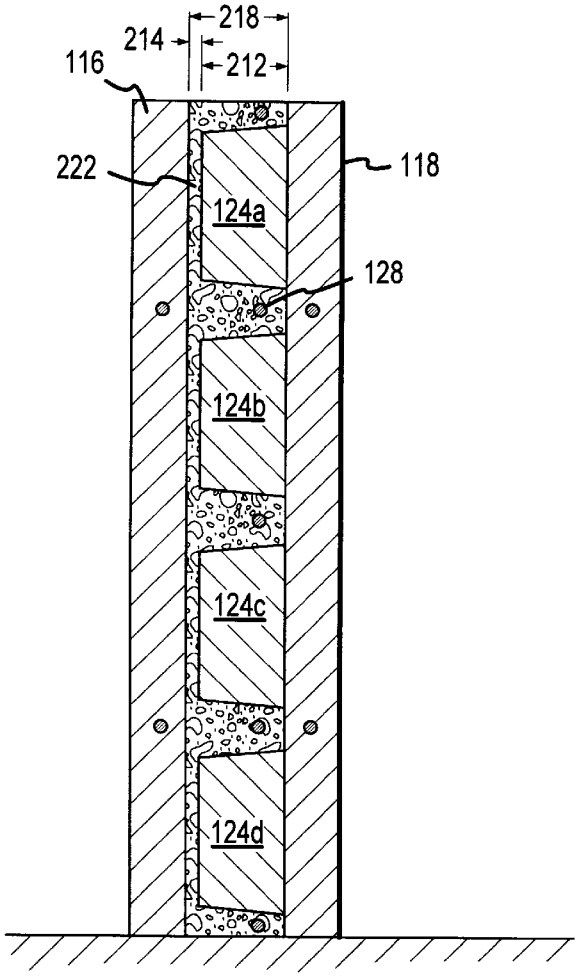
FIG. 2 is a vertical cross-section through a filled mold according to an embodiment of the present invention.
Figure 3:
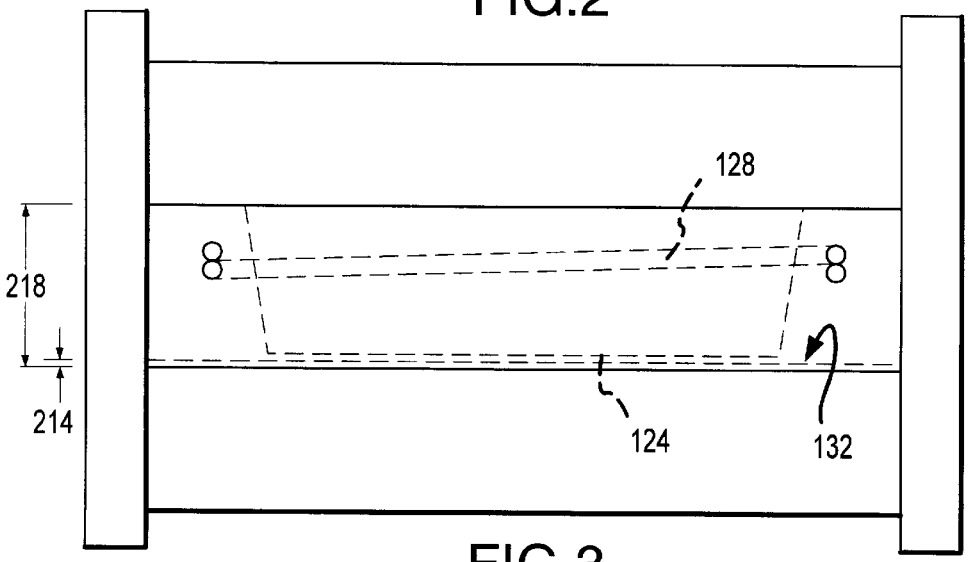
FIG. 3 is a top plan view of a filled mold according to an embodiment of the present invention.

Although the present invention can be used for forming concrete modules which are precast in any of a plurality of different shapes, FIGS. 1–5 depict precasting a concrete module which is generally a rectangular parallelpiped. In the embodiment of FIG. 1, a mold is formed from first and second side panels 112, 114 and first and second doors 116, 118. Components of the mold are positionable 122 as depicted to form a generally rectangular enclosure. In the embodiment of FIG. 1, the second door 118 has a plurality of lightening pans 124*a–d* projecting inwardly (into the interior of the mold) coupled thereto. As best seen in FIG. 2, the lightening pans 124*a–d* have a thickness 212 so as to leave a predefined space 214 between the major surface of the lightening pans and the opposed (first) mold door 116. The pan/door spacing 214 defines the thickness of the panel portions 512*a–d* (FIG. 5) of the finished product. The panel thickness 214 is relatively small such as being less than two inches (about 5 cm), preferably about 1.5 inch (about 3.8 cm) or less, and in some embodiments, about 1.25 inch (about 3.2 cm) or less. For example, when it is desired to produce a panel having a total module thickness 218 of 6 inches, the lightening pans are provided with a thickness 212 of about 4½ inches, leaving a panel thickness 214 of about 1½ inch.

Figure 4:
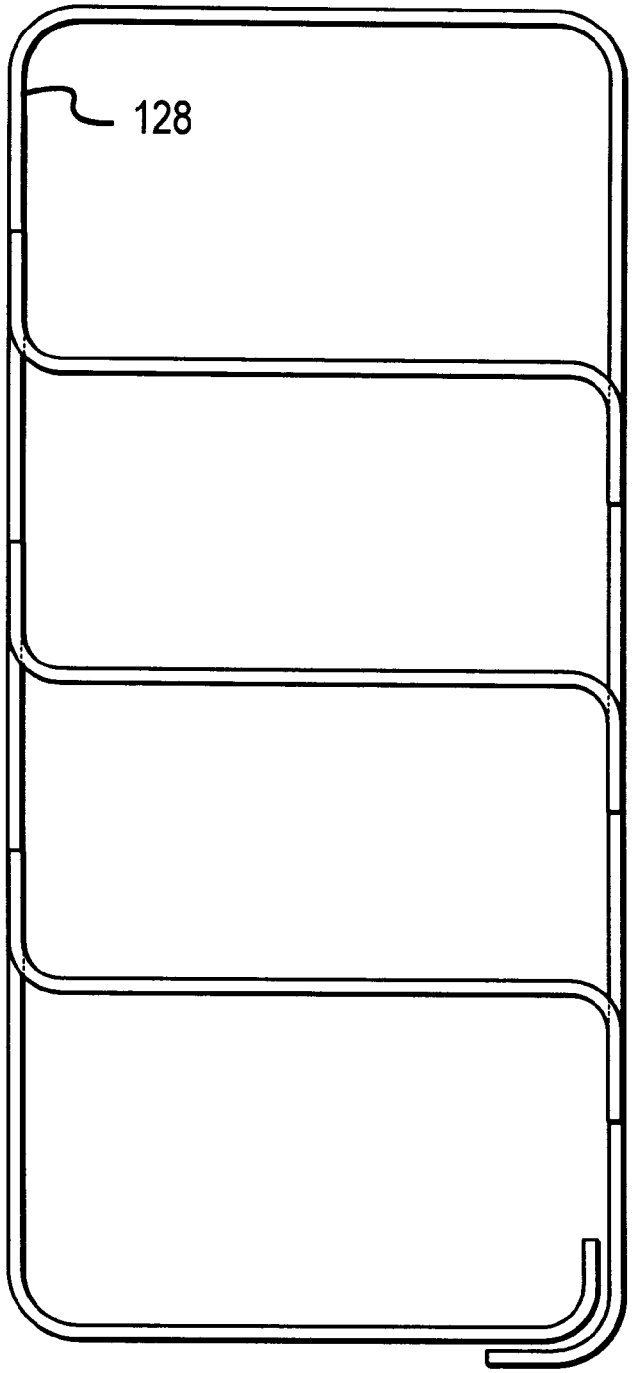
FIG. 4 is a front elevational view of a configuration of steel rib reinforcements usable in connection with the embodiment of FIGS. 1–3.

In the rib regions 514*a–g* which surround the panel portions 512*a–d* (FIG. 5) as depicted in FIG. 1, steel reinforcing bars are positioned (such as by using tie wires) in regions of the mold that will define the ribs 514, which, in one embodiment will have a thickness about twice the thickness of the panel portions. FIG. 4 depicts one possible configuration of the rib-reinforcing bars 128, although other positions would be apparent to those of skill in the art after understanding the present invention.

As depicted in FIG. 1, a sheet of non-metallic reinforcing material in a grid or "scrim" configuration is positioned approximately parallel to the interior surface of the first door 116. Although FIG. 1 shows using the non-metallic material as the sole reinforcing material in the region of the panels, it is also possible to combine non-metallic reinforcing material with, e.g. a steel grid or mesh. In one embodiment, the non-metallic reinforcing material 132 is formed of carbon fiber. In one embodiment, it is possible to form a scrim grid from carbon fiber available from Zoltex Corporation of St. Louis, Mo., such as that sold under the trade name PANEX® 33 continuous carbon fiber (160K). Carbon fiber is believed to be particularly desirable because of its relatively high tensile strength as well as its relative immunity to corrosion or other attack from concrete. Because of such immunity, in at least one embodiment, it is possible to use a carbon fiber scrim grid (CFSG) which is positioned without any coating or other protection to the CFSG. CFSG is also particularly useful because the carbon fibers are highly heat-resistant, being formed, in at least one case, using a process occurring at about 2400° (F.) that "carbonizes" the fibers. In one embodiment, carbon fibers having 48K tow have a cross-sectional area of 0.003 inches (0.07 mm). It is believed that the theoretical moment capacity of a one-inch-thick panel with a 1×1 inch mesh made from Zoltek PANEX with a 48K tow is about 6 Kip inches per foot of panel width. It is believed that for relatively moderate loads, reinforcement ratios less than 0.003 will be more cost effective, so that a larger mesh size or a split tow, or both, may be used.

In one embodiment the CFSG has grid openings of about one inch (about 2.5 cm) or ⅞ inch (about 2.2 cm), and which are preferably somewhat larger (such as about 1.5 times larger) than the largest aggregate size of the concrete being used. It is believed that by providing this grid opening size, the concrete including aggregate can flow freely through the CFSG, resulting in a module having substantial tension-bearing capacity throughout the thin concrete panel(s). In one embodiment, the CFSG may be properly positioned by stretching the material across the thawed area (defining the regions where the panels will reside) 222 and fastening the material around the perimeter of the form. Other manners of positioning the material can be used such as using plastic ties or "zip tying" material to the steel reinforcement 128 in the surrounding ribs. It has been found that merely such stretching and fastening at the perimeter, and taking no special care otherwise to locate the CFSG, nevertheless results in a final product in which the CFSG has at least a 3/16 inch (about 5 mm) cover or more. It is believed that this occurs as the concrete "cream" flows behind the CFSG during filling of the form. A very good bond between the scrim and the concrete can be achieved. Without wishing to be bound by any theory, it is believed that the high quality of the bond is at least partially attributable to a relatively small mesh size and/or the ability of aggregates to lodge within the grid in their final cast position.

In another embodiment, the scrim grid is formed using glass fiber. As one example, a glass fiber grid available from Clark Schebel Inc. of Anderson, S.C., under the trade designation T-1011 can be used. The grid is a glass reinforced epoxy structural grid with warp/fill per inch construction of 1.6×4.0 and OSY weight 12.64. In one embodiment, the grid has a thickness between about 0.0184 and 0.0343 (0.4 mm–0.8 mm) inches and grid openings between about 0.25 and 0.40 inches (6 mm–10 mm). The grid has a tensile strength in excess of 100,000 psi and a tensile modulus estimated to be in excess of $5\times10^6$. Some previous uses of glass fiber have involved non-structural, typically spray-on applications, such as when chopped (typically ¾ inch length) glass fibers are mixed in concrete for fine crack control. Such non-structural applications are believed to derive substantially no reliable increase in tensile strength and furthermore have been subject to clumping in the concrete mixer. Unlike such non-structural applications, the glass fiber reinforcement is used, according to the present invention, for a structural module. Preferably, to reduce or eliminate the potential for attack on the glass fibers by the alkaline material of the cement, the glass fiber reinforcement is preferably coated such as with epoxy resin, rubber, and the like. In one embodiment, glass fiber scrims are subjected to two coating steps, a first coating of resin and a second coating of rubber.

In yet another embodiment, a grid scrim is provided which includes both carbon fibers and other types of fibers such as glass fibers. In one embodiment, a scrim is provided in which every fourth fiber is carbon fiber with the remaining fibers being glass fiber. Without wishing to be bound by any theory, it is believed the presence of the relatively low cost glass fibers in this configuration are particularly useful in providing necessary strength for the module during the early life-time of the module, i.e. during the relatively high-load processes of demolding, transportation, erection and the like. Preferably the scrim is designed such that there are sufficient carbon fibers that the carbon fibers alone, or combined with those portions of the glass fibers that do not deteriorate, are sufficient to provide the necessary strength and load bearing capacity during normal in-place use of the structural modules (including, where appropriate, strength to withstand anticipated normal stresses such as wind loads, earthquake or other vibration and the like). In this way, the amount of relatively expensive carbon fiber required can be reduced and the relatively less expensive glass fibers can be relied upon for the early high-load processes of transportation, erection, etc. It is believed the glass fibers, in addition to performing this early load-bearing function also assist in proper positioning of the carbon fibers during casting.

The non-metallic reinforcement materials have relatively low concrete cover requirements such as providing about ⅜ inch cover (about 10 mm), in some cases, about 3/16 inch cover (about 5 mm). In at least one embodiment, the scrim extends laterally into and through the rib regions and thus the anchoring points of the grid will typically have an inch or more of cover and, it is believed, will achieve the desired increase in tensile strength substantially without regard to the amount of cover in the panel areas. Because of the relatively low cover requirement, and further because the reinforcement materials themselves are relatively thin, the present invention can provide reinforced concrete panels which are relatively thin 214 such as being, in the panel areas, less than about 1½ inch, or in some cases, less than about 1 inch (about 2.5 cm). Further, because of the relatively low minimum cover requirements and because of the tendency of concrete to flow through and behind the scrim grid, proper positioning of the grid can be provided in a relatively low cost and non-labor intensive fashion, without the need to provide spacer devices, multiple ties, or the like.

After the scrim grid 132 is positioned, a mold door 118 is positioned 122 and the mold may be filled with concrete in a manner well known to those of skill in the art. In this way, both the ribs and the panels are cast together and form a monolithic unit. Although conventional concrete formulations can be used, in one embodiment it is useful to use concrete which includes a so-called plasticizer or super-plasticizer, such as that available under the trade designation Viscocrete, from Sika Werke GmbH. Without wishing to be bound by any theory, it is believed that such plasticizers or super-plasticizers, in addition to improving flowabilty and thus decreasing the occurrence of pockets or holes, also provides a stronger product by permitting reduction in the amount of water used.

Figure 5:
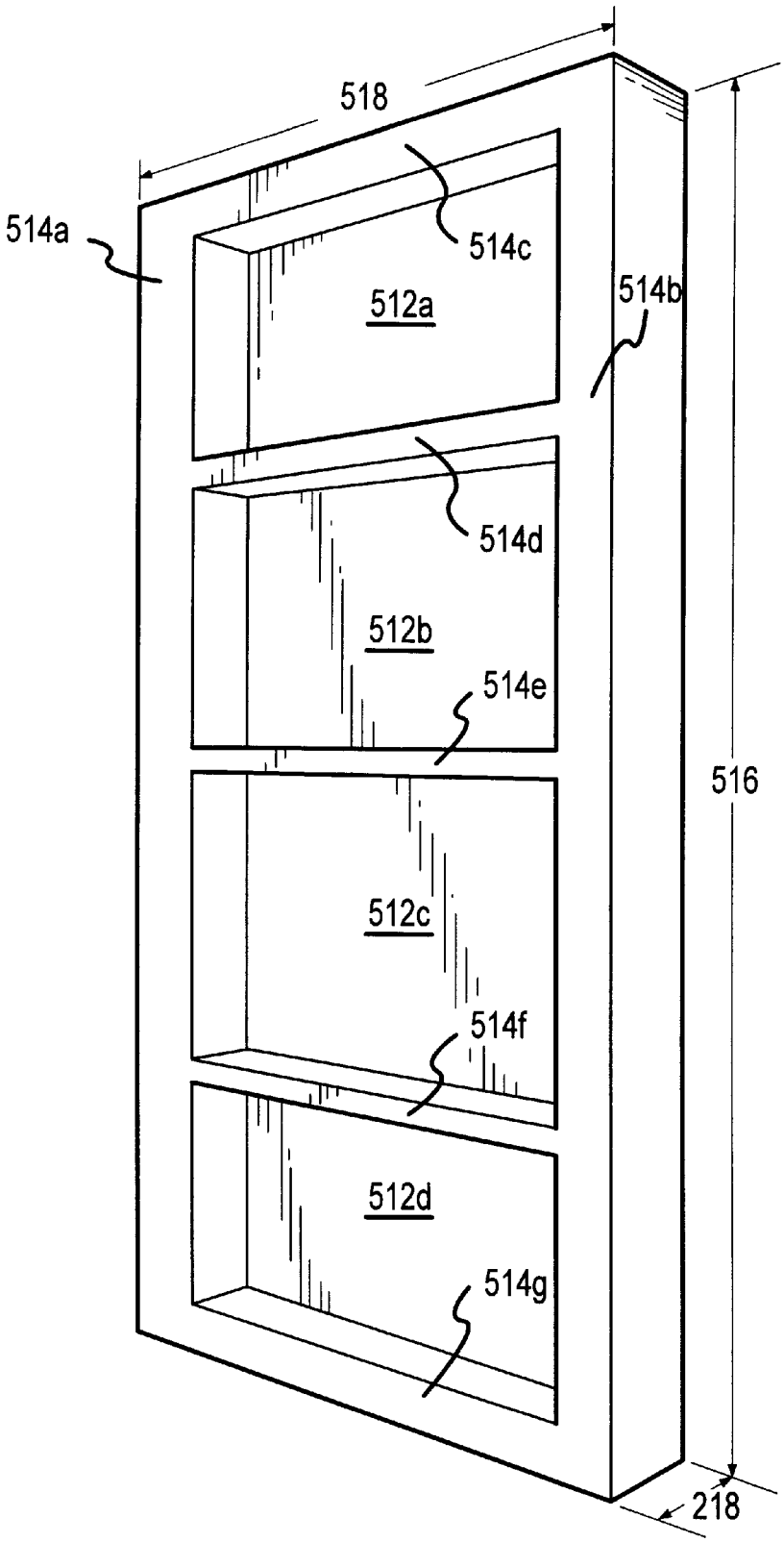
FIG. 5 is a perspective view of structural precast concrete module according to an embodiment of the present invention.

After the concrete has at least partially set, the molds or mold components are removed to provide the precast module as depicted in FIG. 5. A panel such as that depicted in FIG. 5 is able to provide sufficient strength for structural applications while having a weight per square foot (i.e. weight divided by a product of panel height 516 and width 518) of less than about 40 lbs. (about 20 kg), preferably less than about 30 lbs. (about 15 kg). In one embodiment, the height 516 is about 10 feet (about 3 m) and the width 518 is about 55 inches (about 1.5 m).

Figure 6:
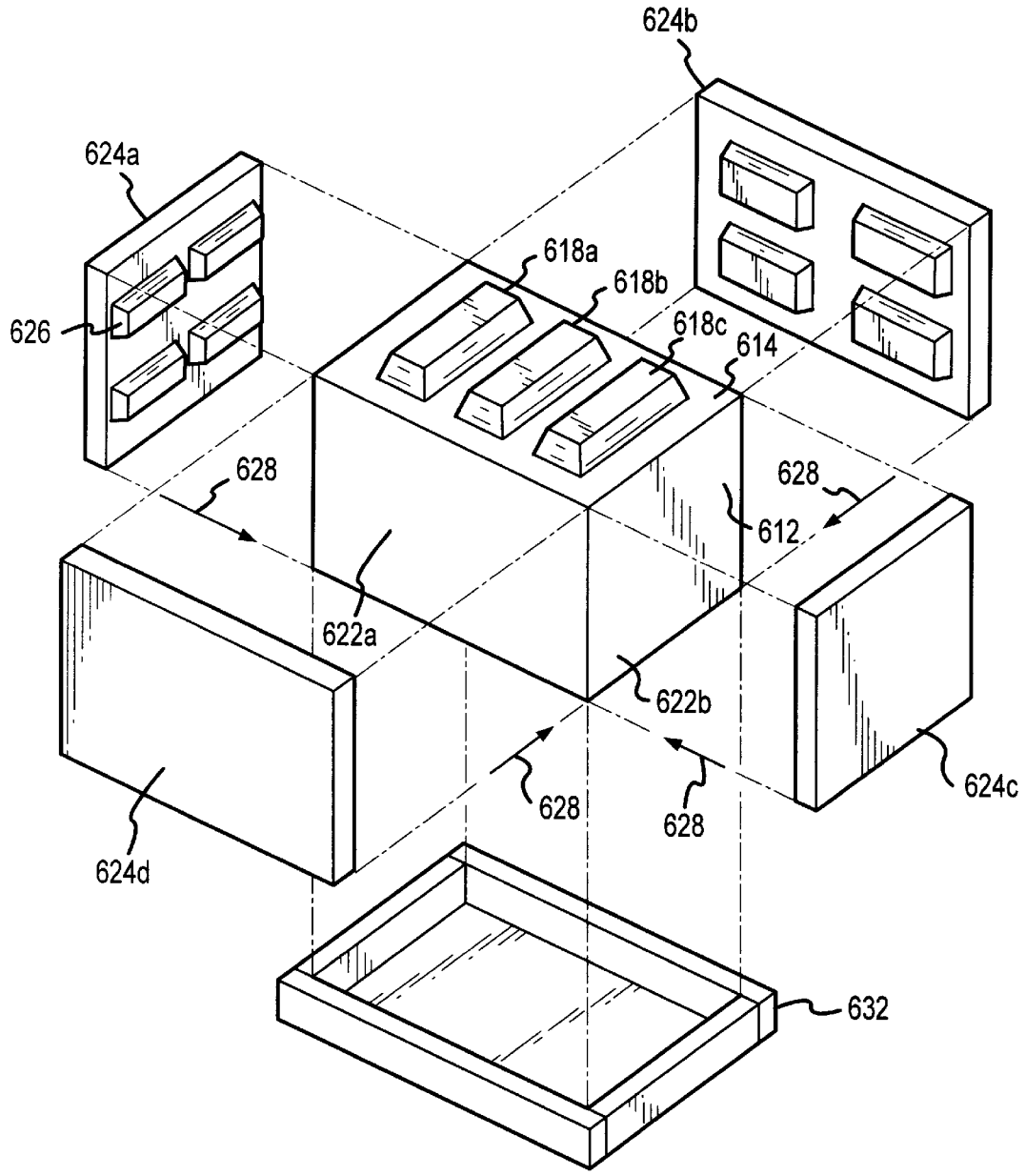
FIG. 6 is a partially exploded perspective view of a mold system according to an embodiment of the present invention.

In addition to a rectangular module as depicted in FIG. 5, modules in other configurations can be provided using the present invention. In one embodiment, a module cast in a monolithic fashion is provided defining the four walls and roof or ceiling of a room such as a hotel room or the like. As depicted in FIG. 6, such a module can be formed using a mold which has an interior inverted tub-shaped component 612 with the upper surface 614 having lightening pans 618*a,b,c* protruding upward into what will become the ceiling portion and relatively flat sidewalls 622*a,b* which will define the interior surfaces of the walls of the room. Non-metallic reinforcing scrim grids (not shown) are positioned, e.g. adjacent the walls 622*a,b* and exterior mold walls 624*a,b,c,d* preferably with lightening pans 626, and preferably with rebar coupled thereto, are positioned 628 adjacent the interior mold 612 so as to define the desired width therebetween. When the exterior mold components are retracted, after the concrete has at least partially hardened, a room component with four walls and a ceiling of a rib and panel construction with non-metallic reinforced panels results. In one embodiment, the resultant module is lifted, e.g., by a crane and positioned over a precast concrete floor module, preferably cast in a frame 632 positioned nearby and attached thereto by e.g. pre-positioned plates, to provide a precast room having four walls, ceiling, and floor, with a relatively low weight per square foot and relatively thin panels such as panels having a thickness of about 1½ inch or less. In one embodiment, room modules formed as described (or modules defining only a portion of a room or other building component such as modules having a portion of a roof and only two walls descending therefrom) can be stacked or otherwise combined to provide a multi-story building formed of precast structural modules. In another embodiment, a mold is configured to cast a unit comprising a floor, ceiling and two walls on edge. After at least partial hardening, the unit is rotated to rest on the floor surface. Cables or other strands are used to pull together two or more such units in edge-to-edge conjunction and the seams between units are then grouted. The addition of endcaps completes the formation of a six-sided room.

In yet a further embodiment, a 5-sided (e.g. floor, three walls and ceiling) structure may be monolithically cast around a core which is later extracted (through the open end), permitting the formation of a six-sided room with the addition of a single endcap (to cover the open end). In one embodiment, use of a plasticizer or super-plasticizer provides sufficient flowability to facilitate casting of the floor portion, monolithically with the wall and ceiling portions, by flowing from edge locations, substantially without the formation of pockets or holes, preferably while reducing or eliminating the need for using vibration or pumping. In one embodiment, such a 5-sided (substantially rectangular parallelpiped) module can be provided with a length of 25 feet, a width of 12 feet and a height of 8½ feet, formed using about 60 lightening pans to form 60 thin-panel regions.

In an additional embodiment, the present invention can be used for forming all or part of a metal stud wall system using metal studs and tracks in-filled with concrete, e.g. for reducing the thickness and/or areal weight of such metal stud wall system components, e.g. generally as described in U.S. provisional patent application Ser. No. 60/054,842, incorporated herein by reference.

In some cases, it is desired to provide a building formed using precast structural modules with interior walls which have similarities in appearance, texture or feel to traditional plastered or "drywall" walls. In one embodiment, panels, such as foam panels (e.g. Styrofoam or similar plastic foam) panels are attached (e.g. using adhesives) to the interior surfaces. The foam panels are then covered with paper, plaster, or other traditional materials. In one embodiment a system such as that available under the trade dcsignation "Whisper Walls" of Aurora, Colo., may be used.

In light of the above discussion, a number of advantages of the present invention can be seen. The present invention makes it feasible to provide precast concrete modules which have sufficient strength and other qualities to permit use as structural members yet provide relatively low areal weights (such as less than about 40 lbs. per square foot). The relatively low weight of precast structural modules provided herein not only assist in reducing the amount of materials used in producing modules, but also provide for reduced costs of fabrication, transportation, and erection. The present invention facilitates the design and construction of modules of a type which include a framework of reinforced ribs such as by providing preferably integral panels for stiffening the ribs against motion, and preferably wherein the panels can accommodate relatively high tension forces without being undesirably thick. Preferably, a module or panel is able to span about 3 to 4 feet with a uniform load of about 60 psf or a concentrated load of about 1,000 lbs. acting over a one square foot area, without excessive deflection or excessive cracking. The present invention provides for the potential to produce a module having a panel which is partially ductile and can withstand high flexural strains without cracking. It is believed that the strength of the fiber will be developed before tensile strength of the concrete is lost. The present invention provides for panel portions which are suitably reinforced while having relatively low cover requirements for the reinforcement material. The present invention provides for reinforcement which is relatively inert with respect to concrete, i.e. which is neither subject to attack or corrosion by the concrete nor itself subject to oxidation, rusting or other deterioration and which has little if any potential for discoloring or otherwise marring the visible surface of a precast concrete module.

A number of variations and modifications of the invention can also be used. It is, in general, possible to use some features of the invention without using others. For example, it is possible to provide for casting of carbon fiber reinforced concrete, preferably in thin panels, without necessarily directing the panels as part of a reinforced-rib structure. If reinforced ribs are used, it is possible to provide for reinforcement of the ribs by materials and procedures other than those depicted, such as using stressed or tensioned cables, metallic or other mesh and the like. Although a particular size and configuration of a precast module has been illustrated, other configurations can also be used such as configurations having different sizes or shapes. Although certain panel reinforcements have been described, other non-metallic panel reinforcement materials that can be used including reinforcements which include ceramic or ceramic fibers, plastic fiber, resin-based material, organic fibers and the like.

The present invention, in various embodiments, includes components, methods, processes, systems and/or apparatus substantially as depicted and described herein, including various embodiments, subcombinations, and subsets thereof. The present invention, in various embodiments, includes providing devices and processes in the absence of items not depicted and/or described herein or in various embodiments hereof, including in the absence of such items as may have been used in previous devices or processes, e.g. for achieving ease and reducing cost of implementation.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended the appended claims be construed to include alternative embodiments to the extent permitted.

What is claimed is:

1. A precast concrete module comprising:

a plurality of reinforced concrete ribs defining regions therebetween, wherein at least a first said region is substantially covered with at least a first concrete panel, wherein concrete in said ribs is cast and cured substantially simultaneously with concrete in said panels whereby said panels are coupled to said ribs substantially preventing relative rib movement, said ribs having a rib thickness in a first dimension, said panels having a panel thickness in said first dimension that is less than of said rib thickness, at least said first concrete panel being reinforced with a non-metallic reinforcement material comprising both carbon fiber and glass fiber, wherein said ribs define a maximum extent of said concrete module in said first dimension, and wherein exterior surfaces of said ribs are formed from concrete.

2. A precast concrete module as claimed in claim 1 wherein said non-metallic reinforcement material comprises a coated fiber scrim.

3. A precast concrete module as claimed in claim 1 wherein said non-metallic reinforcement material comprises a rubber-coated fiber scrim.

4. A precast concrete module as claimed in claim 1 wherein said non-metallic reinforcement material is a grid comprising about 25% carbon fiber.

5. A precast concrete module as claimed in claim 1 wherein said panel thickness is less than about 1½ inch.

6. A precast concrete module as claimed in claim 1 wherein said panel thickness is less than about 1.25 inch.

7. A precast concrete module as claimed in claim 1 wherein said ribs are steel-reinforced.

8. A precast concrete module as claimed in claim 1 wherein said rib thickness is at least about 4 inches.

9. A precast concrete module as claimed in claim 1 wherein said rib thickness is at least about 6 inches.

10. A precast concrete module as claimed in claim 1 wherein said module is a structural weight bearing module.

11. A precast concrete module as claimed in claim 1 wherein said panel defines a first plane, wherein said module defines an area over a plane substantially parallel to said first plane, and wherein said module has a weight, divided by said area, of less than about 40 pounds per square foot.

12. A precast concrete module as claimed in claim 1 wherein said panel defines a first plane, wherein said module defines an area over a plane substantially parallel to said first plane, and wherein said module has a weight, divided by said area, of less than about 30 pounds per square foot.

13. A precast concrete module as claimed in claim 1 wherein said concrete includes aggregate defining a maximum aggregate size and wherein said non-metallic reinforcement material defines a grid with a grid spacing greater than said maximum aggregate size.

14. A precast concrete module as claimed in claim 1 wherein said panel defines a major plane and wherein said non-metallic reinforcement material is positioned at least about 3/16 inch from any surface of said panel parallel to said plane.

15. A method for forming a precast concrete structural module comprising:

providing a mold defining a plurality of panel regions having at most a panel thickness and also having a plurality of rib regions having at least a first rib thickness greater than said panel thickness, at least a first said panel region and a first said rib region being continuous with respect to each other, wherein said first rib thickness defines a maximum thickness of said concrete structural module, and wherein said panel thickness is less than said rib thickness;

positioning steel reinforcement in at least one of said rib regions;

positioning non-metallic mesh reinforcement in at least one of said panel regions, wherein said non-metallic mesh reinforcement includes both carbon fiber and glass fiber;

filling said mold with concrete;

removing said mold from said concrete after said concrete has at least partially hardened, wherein exterior surfaces of said rib regions are concrete.

16. A method as claimed in claim 15 wherein said step of positioning non-metallic mesh reinforcement comprises positioning a grid.

17. A method, as claimed in claim 15, wherein said step of filling comprises filling with concrete which includes a plasticizer.

18. A method, as claimed in claim 17, wherein said plasticizer comprises Viscocrete.

* * * * *